US005660557A

United States Patent [19]

Lemke et al.

[11] Patent Number: 5,660,557

[45] Date of Patent: Aug. 26, 1997

[54] SHROUD LATCH FOR ELECTRICAL CONNECTORS

[75] Inventors: Timothy A. Lemke, Dillsburg; Timothy W. Houtz, Etters, both of Pa.

[73] Assignee: Berg Technology, Inc., Reno, Nev.

[21] Appl. No.: 581,391

[22] Filed: Dec. 29, 1995

[51] Int. Cl.[6] ..... H01R 13/62

[52] U.S. Cl. ..... 439/328; 439/358

[58] Field of Search ..... 439/327, 325, 439/357, 358, 62, 637, 634, 632, 59, 328

[56] References Cited

U.S. PATENT DOCUMENTS

| | | | |
|---|---|---|---|
| 3,533,045 | 10/1970 | Henschen | 339/17 |
| 3,544,951 | 12/1970 | Roberts | 439/358 |
| 3,573,706 | 4/1971 | Haberlen | 339/17 |
| 4,006,955 | 2/1977 | Johnson | 339/91 R |
| 4,172,626 | 10/1979 | Olsson | 339/17 F |
| 4,373,765 | 2/1983 | Ritter | 339/75 MP |
| 4,917,625 | 4/1990 | Haile | 439/358 |
| 4,923,409 | 5/1990 | Ishii | 439/357 |
| 5,494,451 | 2/1996 | Bowers | 439/328 |

*Primary Examiner*—Khiem Nguyen
*Assistant Examiner*—Yong Ki Kim
*Attorney, Agent, or Firm*—Bruce J. Bowman, Esq.; Daniel J. Long, Esq.; M. Richard Page, Esq.

[57] ABSTRACT

A removable shroud latch for securing a printed circuit board (PCB) or second connector (device) to a first connector has a rectangular base which surrounds the first connector. The shroud latch engages the device by means of two pairs of inwardly biased arms that extend from the top of the elongated sides to engage opposite sides of either a hole in the PCB by means of knobs centered on the inward side of outwardly flared flanges at the upper ends of the arms or to an edge of the second connector. A plurality of inwardly extending shoulders on the bottom of the elongated sides engage the bottom edge of the first connector to prevent upward vertical movement of the shroud latch.

14 Claims, 3 Drawing Sheets

SHROUD LATCH FOR ELECTRICAL CONNECTORS

BACKGROUND OF THE INVENTION

1. Field of the Invention

The present invention relates to a device for latching an electrical connection device e.g., an expansion card or a connector to a receiving connector and, more particularly, to a removable shroud type latch that engages ahd surrounds the receiving connector and has engaging portions that removably retain the electrical connection device.

2. Description of Related Art

In expandable electronic devices of today, it is important to maintain various add-on devices and the like, in good electrical contact. This avoids power failures that may hinder proper operation of those devices.

It is common for many different types of single-board electronic systems, such as computers, to have a printed circuit board ("PCB") with a number of soldered connectors in which printed circuit cards or boards, commonly known as "expansion cards," are plugged into at vertical planes with respect to the connectors. However, because of external forces such as shock, vibration, or in the case of cable connector systems, the direct pulling of a cable attached to a connector, the cards are prone to becoming unplugged from the connectors.

One method for preventing the cards from becoming unplugged from the connectors is to increase the normal force of the contact, which in effect increases the retention ability of the connector. However, this method is not practical for a number of reasons. First, the size of the connector may preclude increasing the force of the contact. Second, increasing the contact forces results in increased contact wear. Finally, high forces can create difficulties in plugging and unplugging the card into the connector. To overcome these shortcomings, prior art latching systems provided forces independent from the contact forces, in other words, the latches could be engaged and disengaged independently of the engagement or disengagement of the card to the connector contacts. These latching systems included those used in connection with cable-to-board connectors, in which cables had either plastic or metal latches at their ends which could be squeezed to engage or disengage the connectors. These latching systems, however, could not be used with board-to-board connectors and other similar connector systems.

A common latching device is illustrated by U.S. Pat. No. 3,573,706, entitled "Connector for Mounting a Printed Circuit Board on a Mounting Bar." The '706 patent discloses a connector with a removable "H-shaped" latching spring clip which secures a printed circuit board to a mounting bar. The clip has a first pair of legs which latches the clip to the mounting bar. A second pair of legs extends upwardly from the mounting bar, each leg having a nose with a cammed face which engages the other leg in a hole in the board. However, one drawback of using a device such as this is that when using metal connectors, the metal body of the connector is not also protected from inadvertent electrical contact to other electrically conductive members of a particular assembly. In other words, this structure does nothing to reduce the possibilities of, e.g., electrical short circuits or electrostatic discharge. Furthermore, because the legs which engage the hole on the board cam upwardly at an angle and only contact the board in the hole at some distance from the connector, there is no lead-in for the board. Thus, it can be difficult to blindly mate the board to the connector, which increases the possibility of damaging the connector.

Another conventional latching structure utilizing cammed members with contact pins which engage in a hole of a printed circuit board is disclosed in U.S. Pat. No. 4,373,765, entitled "Plug Connection for Ribbon Cables." The '765 Patent teaches a latching system which is integrated into the connector design. However, a latching system may not be required under all circumstances and conditions. Therefore, a drawback to this system is that it would be very costly to implement these connectors on a PCB to safeguard against situations where it would not be necessary. Furthermore, these latching systems must be fabricated from materials able to withstand high surface mount solder temperatures for when the connector is soldered to the PCB. These materials are generally much more expensive than, e.g., thermoplastic polymers which are unable to withstand these extreme temperatures.

With respect to multiple-board electronic systems, such as mainframes or other high-speed systems, it is common to instead have two-piece connectors because of their greater reliability. However, some of the same concerns regarding board-to-board connectors, namely unplugging, inadvertent electrical contact, and high cost, apply to latching systems for securing two connectors as well. It can thus be generally said that where electrical connectors and connections are concerned, the aforementioned problems exist. Therefore, it would be desirable to have a latch that could alleviate these problems.

With the above considerations in mind, it is an object of the present invention to provide a latch system for positively retaining an electrical connection device to a connector.

It is an object of the present invention to provide a latch for retaining an expansion card to a single-board connector.

It is a further object of the present invention to provide a latch for a single-board connector with a significant lead-in to make blind mating of the connector easier, thus reducing the potential for damaging connectors or other components.

It is a still further object of the present invention to provide a latch system for securing two connectors on a multi-board system.

It is another object of the present invention to provide a latch system which is insulated to protect a metal connecting body from inadvertent electrical contact to other electrically conductive members of an assembly, thereby reducing the possibility of short circuits or electrostatic discharge.

It is yet another object of the present invention to provide a removable shroud latch which can be applied after the soldering process, so that it does not have to be made from a high temperature plastic.

SUMMARY OF THE INVENTION

The present invention is a removable latch that surrounds a receiving electrical connector and clasps or catches a received electrical device such as a printed circuit board or another connector in order to help retain and maintain the received electrical device in electrical contact with the receiving connector. This is generally accomplished by a rectangular base or shell that surrounds or shrouds the outside periphery of the receiving connector and that includes upper and lower engaging portions for the received electrical device and the receiving connector, respectively.

The lower engaging portions may take the form of inwardly extending shoulders transversely situated on bottom ends of a pair of opposite sides of the shell. The upper engaging portions extend normal to the upper ends of a pair of opposite sides of the shell and are naturally biased inwardly towards each other.

In one form thereof, the present invention is a removable shroud-type latch for securing a printed circuit board accessory, such as an expansion card, to a circuit board connector. The shroud latch is formed of an insulating, inexpensive thermoplastic polymer material with relatively low thermal properties. The shroud latch has a rectangular base which engages and surrounds the connector, and upwardly extending arms which grip the accessory to the connector.

In one embodiment of the latch, for attaching an expansion card or other printed circuit board to the connector, a pair of arms curving inward and then upwardly extending from the upper end of opposite sides of the base, support the expansion card in a vertical plane with respect to the connector. Each arm has a pair of parallel spaced vertical appendages which connect at their top ends to an outwardly flared flange. The flanges have a pair of knobs located on the flange in the position directly above each of the vertical appendages. The arms are naturally biased in a closed position so that when the expansion card is inserted into the connector, the flanges spread apart and then bias themselves so that the knobs fall into depressions or holes in the expansion card. The vertical appendages rest against and provide support for the card, thereby providing a lead-in for facilitating the blind mating of the card with the connector.

In a second embodiment of the latch, for attaching a received connector to the receiving connector, opposite sides of the base each have a pair of upwardly extending vertical appendages. Each appendage has a flange extending from its top end. The flanges are also outwardly flared, but each have a knobbed ledge so that when one connector is attached to the other connector, the bottom edges of the received connector snap under the ledge and are secured in place relative to the receiving connector.

In each embodiment, the base has inwardly transverse extending shoulders or lips on the lower ends of the opposite sides of the base having the arms. These shoulders fit around the lower end of the receiving connector.

BRIEF DESCRIPTION OF THE DRAWINGS

The above-mentioned and other features, advantages and objects of this invention, and the manner in which they are obtained, will become more apparent and will be best understood by reference to the detailed description in conjunction with the accompanying drawings which follow, wherein.

DESCRIPTION OF THE PREFERRED EMBODIMENTS

Figure 1:
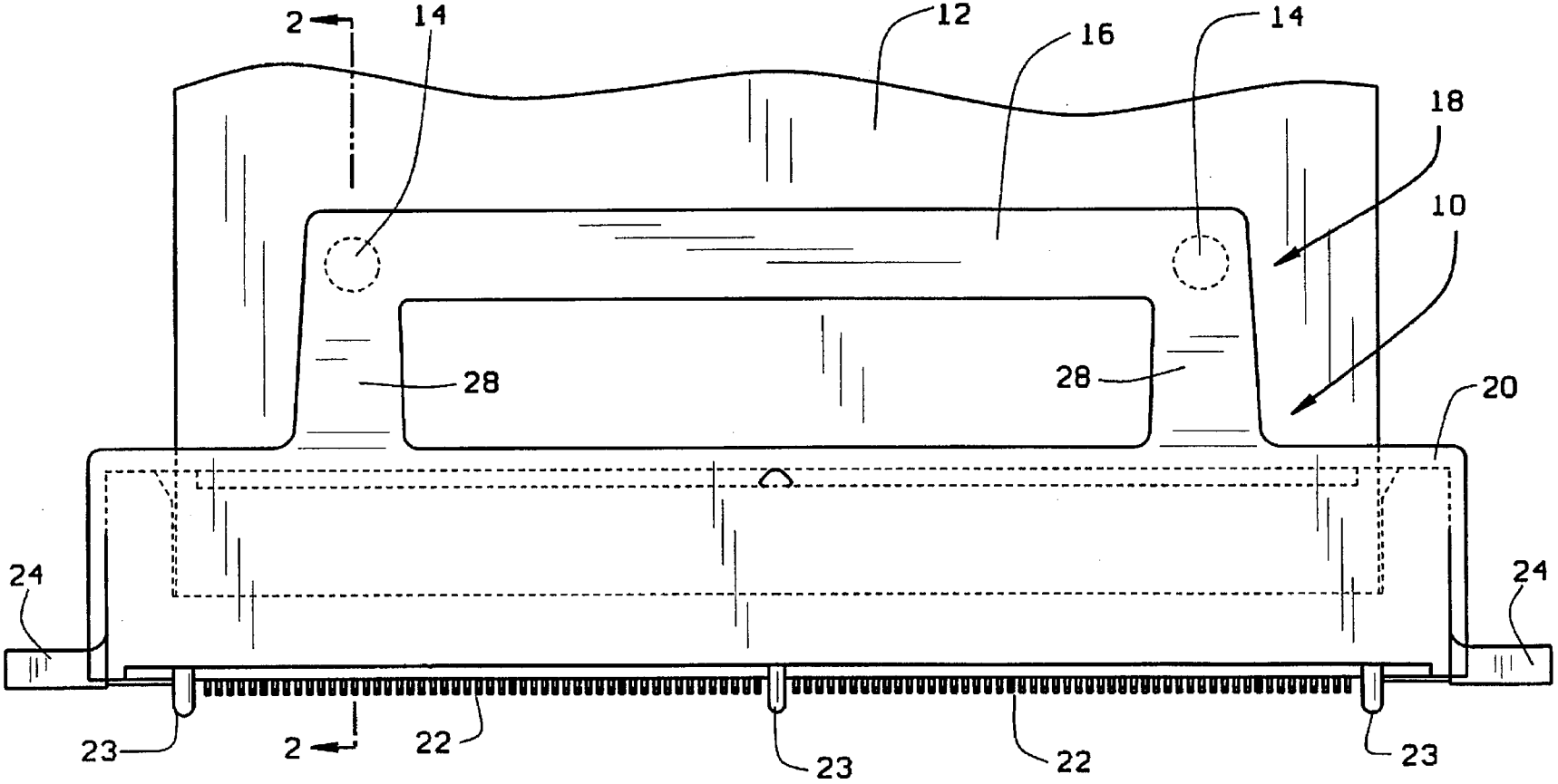
FIG. 1 is a front elevational view of an embodiment of the present shroud latch surrounding the connector and engaging a printed circuit card.
Figure 3:
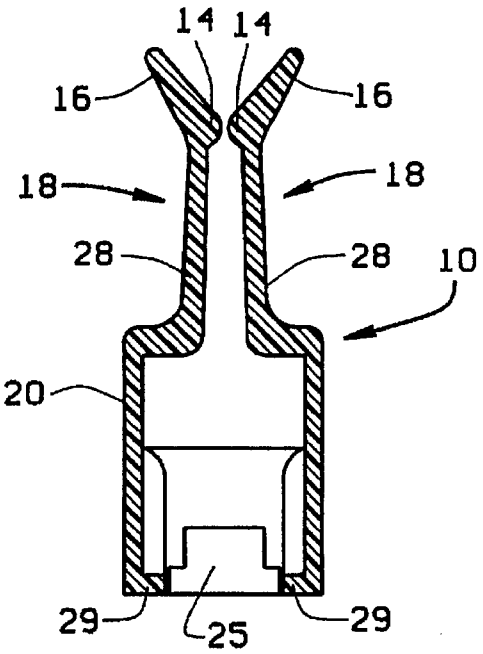
FIG. 3 is a cross-sectional view of the shroud latch of FIG. 1.
Figure 2:
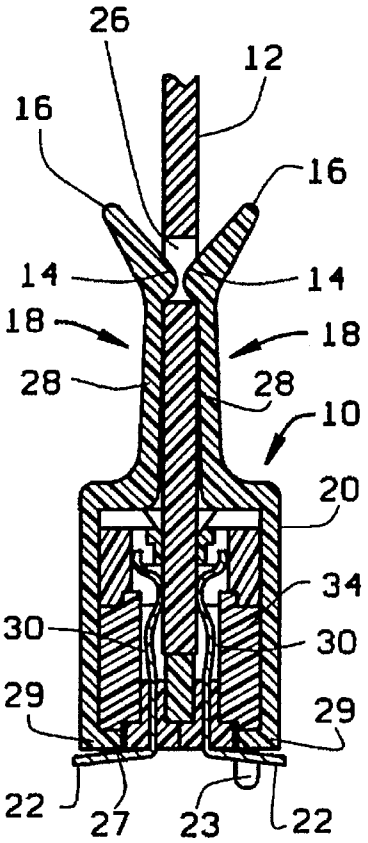
FIG. 2 is a cross-sectional view of the shroud latch and connector taken along line 2—2 of FIG. 1.

Referring to FIGS. 1–3, a first embodiment of a shroud latch 10 is shown securing a printed circuit card 12 in a vertically planar position in and with respect to a connector 34. The connector 34 is adapted to be mounted to a printed circuit board (PCB) such as a motherboard, or the like. This type of board-to-board connection is common with single-board systems, such as attaching an expansion card onto the motherboard of a computer. The shroud latch 10 generally includes a rectangular base or shell 20 with first and second opposing, upwardly extending elongated arms 18 which terminate in flanges 16. Because in some systems the connector 34 is metal, the shroud latch 10 is fabricated of a thermoplastic polymer material to shield the metal body of the connector 34 from inadvertent electrical contact to other electrically conductive members of a particular PCB assembly.

The base 20 is a rectangular-shaped hollow frame with four vertically extending walls which can be inserted over the connector 34. The base 20 thus surrounds the connector 34 once in place. The connector 34 is an edge card connector, a type well-known in the art, having an elongated housing with many contact leads 30 extending the entire length of the connector 34. The contact leads 30 extend from the bottom of the connector 34 and are known as solder tails 22. Preferably, the connector 34 also has an integral pair of attachment lugs 24 which extend horizontally from the bottoms of the shorter sides of the connector 34 for allowing the connector 34 to be attached to another device, such as a PCB, by means of screws or other hold down devices that would extend therethrough. The connector 34 further includes several alignment pins 23 for properly positioning the connector 34 on the particular PCB.

Once the rectangular base 20 is positioned around the connector 34, a pair of slots 25 located on each of the shorter sides of the base 20 fit around the attachment lugs 24 on the connector 34. Additionally, each elongated side of the base includes an inwardly extending ledge 29 that partially wraps around and snaps under the underside of the connector 34 into longitudinal grooves 27 as the shroud is pushed into the connector.

On each elongated side of the base 20, the arms 18 curve inward to a position such that a space approximately the thickness or slightly less of the card 12 lies between the arms 18. Each arm 18 consists of a pair of vertical appendages 28 that are in spaced parallel relationship to one another. The appendages 28 on each arm 18 connect at their ends to a horizontal, outwardly flared elongated flange 16. On the inner portion of each elongated flange 16 is a pair of knobs 14 that are positioned such that one knob 14 is directly above each appendage 28. The respective knobs 14 on each flange 16 extend forward and may contact the oppositely disposed knobs 14 on the other flange 16 through depressions or holes 26 on the card 12 in order to secure the card 12 to the connector 34. Thus, through the resiliency of the arms 18, the flanges 16 and knobs 14 tend to contact.

The arms 18 are naturally biased in a closed position wherein opposite knobs 14 on opposite flanges 16 are in contact. When the card 12 is inserted into the connector 34 the arms 18 spread apart and lead the card 12 into the connector 34. When the holes 26 on the card 12 are aligned with the knobs 14 on the flanges 16, the arms 18 snap back into position as the knobs 14 engage the card 12. The vertical appendages 28 directly contact and support the card 12 whilst in place.

Figure 5:
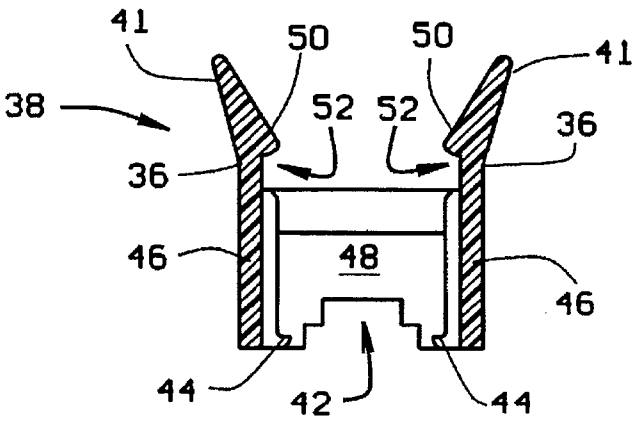
FIG. 5 is a cross-sectional view of the shroud latch of FIG. 4.
Figure 4:
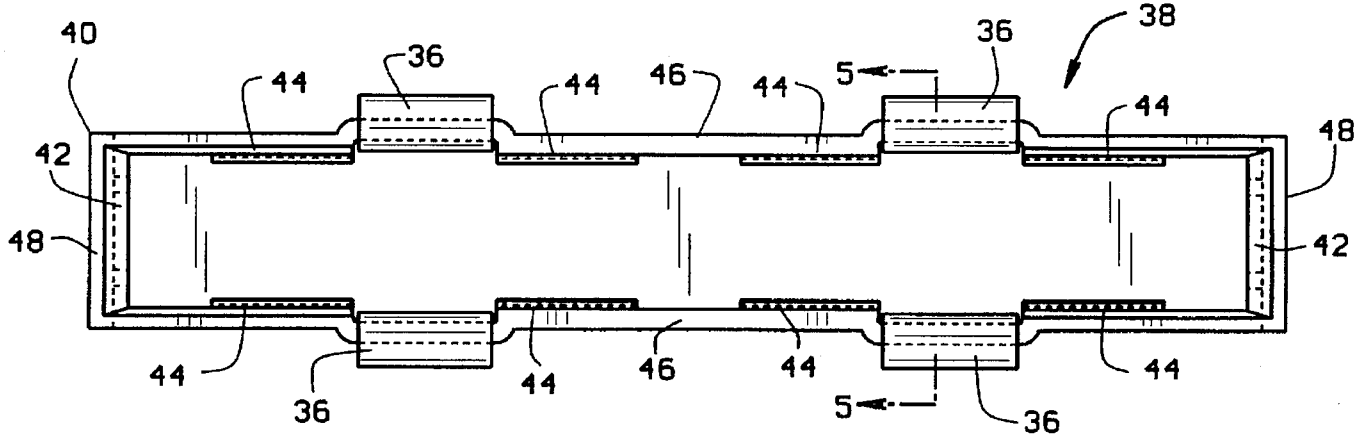
FIG. 4 is a top plan view of a second embodiment of the present shroud latch.
Figure 6:
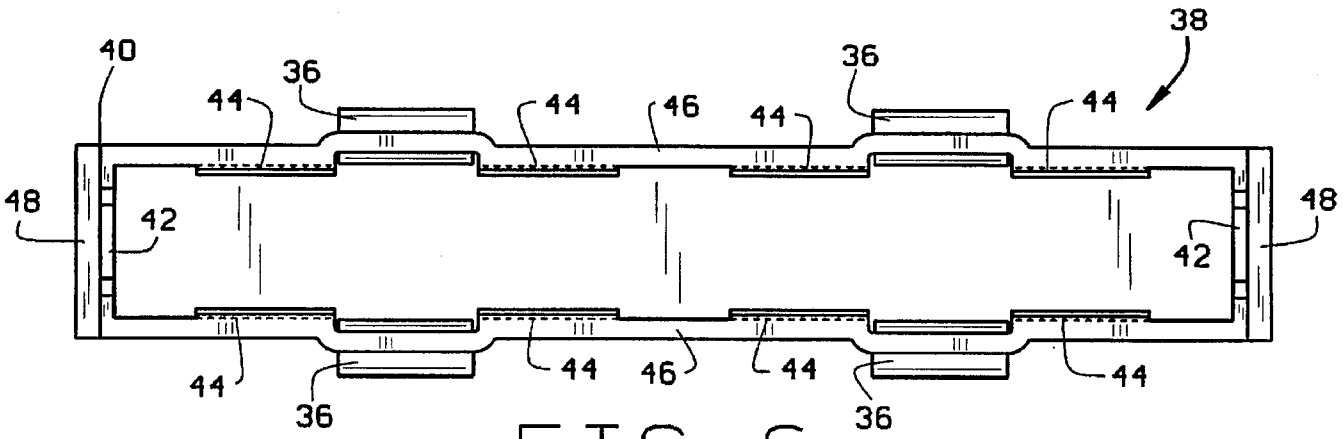
FIG. 6 is a bottom plan view of the shroud latch of FIG. 4.

Referring to FIGS. 4–6, a second embodiment of the present shroud latch, here designated 38, is shown. This shroud latch 38 is preferably used to secure together two connectors (not shown) wherein the shroud latch 38 surrounds the first connector (not shown) and latches or clasps around an edge of the second connector (not shown). Such connector-to-connector assemblies are commonly used within multiple-board systems, such as mainframes or other high-speed systems, because of their greater reliability.

The shroud latch 38 generally has a rectangular base 40 comprised of two elongated sides 46 and two shorter sides 48. Each side 48 has an inverted T-shaped slot 42 positioned on its lower end which are adapted to fit around attachment lugs (not shown) of the connector (not shown).

Vertically extending from each elongated side 46 is a pair of arms or appendages 36. The four appendages 36 generally extend upwardly from the bottom of the respective elongated side 46 of the base 40, up past the top of the base 40 and include outwardly flared flanges 41 extending from the tops of the appendages 36. At the beginning of the flanges 41 is a knob or protrusion 50 thereby creating a ledge 52 between the appendage 36 and the flange 41.

The latch 38 further includes a plurality of inwardly projecting shoulders 44 transversely extending from the bottom of the elongated sides 46. The shoulders 44 extend underneath the bottom edge of the connector (not shown) to prevent the latch 38 from vertically coming off of the connector. Thus, the shroud latch 38 is coupled to the first connector by positioning the base 40 around the sides of the first connector. The plurality of inwardly protruding shoulders of the base 40 extend about the bottom of the connector while the slots 42 fit around the attachment lugs of the connector and pressing the shroud axially onto the connector and allowing the shoulders 44 to snap into grooves along the bottom edge of the connector. In this manner, the shroud latch 38 surrounds the connector and is prevented from upward travel. The second connector (not shown) is then held to the first connector through an end of the second connector. The second connector is thus prevented from disengagement by the knobs 50 and the natural resilient inward biasing of the flanges 41.

Accordingly, while this invention is described with reference to preferred embodiments of the invention, it is not intended to be construed in a limiting sense. It is rather intended to cover any variations, uses or adaptions in the invention utilizing its general principles. Various modifications will be apparent to persons skilled in the art upon reference to this description. It is therefore contemplated that the appended claims will cover any such modifications or embodiments as fall within the true scope of the invention.

What is claimed is:

1. A removable latch for securing an electrical component to an electrical connector having a first pair of opposite sides, a second pair of opposite sides, a top, and a bottom, the latch comprising:

a base defined by a first pair of opposite sidewalls and a second pair of opposite sidewalls coupled together at their ends, said base adapted to surround the periphery of the first and second opposite pairs of sides of the connector;

a pair of oppositely disposed identical arms, each arm upwardly extending from a top end of one of the sides of said first pair of opposite sidewalls, each arm comprising a pair of parallel spaced appendages; and a pair of slots, each slot positioned on one of said sidewalls of said second pair of sidewalls for insertion over an attachment lug on the connector.

2. The latch of claim 1, wherein said first and second pairs of arms form opposite pairs that are biased inwardly towards each other.

3. The latch of claim 1, wherein said latch is fabricated from a thermoplastic polymer.

4. A removable latch for securing an electrical component to an electrical connector having a first pair of opposite sides, a second pair of opposite sides, a top, and a bottom, the latch comprising:

a base defined by a first pair of opposite sidewalls and a second pair of opposite sidewalls coupled together at their ends, said base adapted to surround the periphery of the first and second opposite pairs of sides of the connector wherein each one of said second pair of opposite sidewalls includes a notch on a lower end thereof so as to form around a respective attachment loop of the connector;

first and second pairs of upwardly extending arms respectively disposed on a top end of said first pair of opposite sidewalls, each arm including an outwardly extending flange defining a shelf, said flange adapted to extend about the electrical component; and a plurality of inwardly extending shoulders disposed on a bottom end of said first and second pairs of opposite sidewalls.

5. A removable latch for securing a printed circuit board in a vertical plane with respect to a connector to the connector, the latch comprising:

a rectangular base adapted to surround the connector and having a first pair of opposite sides and a second pair of opposite sides, said first pair of sides being longer than said second pair of sides and attached to each other at their ends;

a pair of oppositely disposed identical arms, each arm extending upwardly from a top end of one of said sides of said first pair of sides and comprising a pair of parallel spaced vertical appendages, said vertical appendages connected at their top ends to a horizontally extending outwardly flared flange, each flange having a pair of knobs, each knob positioned on said flange above said vertical appendages; and a pair of slots, each slot positioned on one of the sides of the second pair of sides for insertion over an attachment lug on a connector.

6. The shroud latch of claim 5, further comprising:

a plurality of shoulders transversely extending from a bottom end of said first pair of sides.

7. The shroud latch of claim 5, wherein each said pair of parallel spaced vertical appendages are coupled together by a transverse member.

8. The shroud latch of claim 5, wherein said shroud latch is fabricated from a thermoplastic polymer.

9. The shroud latch of claim 5, wherein said arms curve inward from said base to a position approximately equal to the width of an expansion card.

10. The shroud latch of claim 5, wherein said arms are naturally biased in a closed position.

11. A removable latch for securing a second connector to a first connector, the latch comprising:

a base adapted to surround the outside periphery of the first connector, said base defined by oppositely disposed first and second side walls, and oppositely disposed third and fourth sidewalls, said first and second sidewalls coupled to said third and fourth sidewalls at their respective ends;

a first and second arm upwardly extending from a top end of said first sidewall, said first and second arm each terminating in an outwardly flared flange having an inwardly projecting ledge;

a third and fourth arm upwardly extending from a top end of said second sidewall, said third and fourth arm each terminating in an outwardly flared flange having an inwardly projecting ledge; and a plurality of shoulders transversely inwardly extending from a bottom of both said first and second sidewall.

12. The latch of claim 11, wherein said first and third arm, and said second and fourth arm form opposite pairs of inwardly biased arms.

13. The latch of claim 11, further comprising:

a first slot in a bottom end of said third sidewall and adapted to extend around a first attachment loop of the connector; and a second slot in a bottom end of said fourth sidewall and adapted to extend around a second attachment loop of the connector.

14. The latch of claim 11, wherein said latch is fabricated from a thermoplastic polymer.

* * * * *